US007520771B2

(12) United States Patent
Nall et al.

(10) Patent No.: US 7,520,771 B2
(45) **Date of Patent: *Apr. 21, 2009**

(54) LED STRING LIGHT ENGINE AND DEVICES THAT ARE ILLUMINATED BY THE STRING LIGHT ENGINE

(75) Inventors: Jeffrey Nall, Brecksville, OH (US); Paul Southard, Broadview Heights, OH (US); Matthew Mrakovich, Streetsboro, OH (US); Mark Scarlato, Westlake, OH (US); Ronald Brengartner, Jr., Strongsville, OH (US); Koushik Saha, Brunswick, OH (US); Yu Pan, Shanghai (CN)

(73) Assignee: Lumination LLC, Valley View, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/539,089

(22) Filed: Oct. 5, 2006

(65) Prior Publication Data

US 2007/0087619 A1 Apr. 19, 2007

Related U.S. Application Data

(63) Continuation-in-part of application No. 11/180,993, filed on Jul. 13, 2005, now Pat. No. 7,160,140.

(51) Int. Cl.
*H01R 4/24* (2006.01)

(52) U.S. Cl. ..... 439/417

(58) Field of Classification Search ..... 439/417–420
See application file for complete search history.

(56) References Cited

U.S. PATENT DOCUMENTS 4,855,882 A 8/1989 Boss
6,017,241 A 1/2000 Komai
6,074,074 A 6/2000 Marcus
6,505,955 B1 1/2003 Hatjasalo et al.
6,517,218 B2 2/2003 Hochstein
6,566,824 B2 * 5/2003 Panagotacos et al. ..... 315/291
6,660,935 B2 * 12/2003 Southard et al. ..... 362/640
6,834,980 B2 12/2004 Okano et al.
6,837,598 B2 1/2005 Marcus
2002/0110000 A1 8/2002 Marcus
2002/0136008 A1 9/2002 Frei et al.

(Continued)

FOREIGN PATENT DOCUMENTS

EP 0 818 652 B1 7/1997

(Continued)

OTHER PUBLICATIONS

Partial International Search Report mailed Nov. 7, 2006.

(Continued)

*Primary Examiner*—James Harvey
(74) *Attorney, Agent, or Firm*—Fay Sharpe LLP

(57) ABSTRACT

A string light engine includes a plurality of LEDs, a plurality of IDC connectors, and an insulated flexible conductor. Each IDC connector is in electrical communication with at least one of the plurality of LEDs and is operatively mechanically connected to at least one of the plurality of LEDs. The IDC connectors attach to the conductor.

23 Claims, 13 Drawing Sheets

U.S. PATENT DOCUMENTS

2002/0149948 A1 10/2002 Okano et al.
2003/0063463 A1* 4/2003 Sloan et al. ..... 362/238
2004/0115984 A1 6/2004 Rudy et al.
2005/0207151 A1 9/2005 Aanegola et al.
2005/0221659 A1 10/2005 Mrakovich et al.
2006/0035511 A1 2/2006 Mrakovich et al.
2006/0116021 A1 6/2006 Dennes et al.
2006/0158882 A1* 7/2006 Klomp et al. ..... 362/240
2006/0164831 A1* 7/2006 Lai ..... 362/231

FOREIGN PATENT DOCUMENTS

EP 1 233 232 A2 11/2001
WO WO 90/02906 3/1990
WO WO 2004/023033 3/2004

OTHER PUBLICATIONS

Philips catalog, Solid State Lighting Beyond Neon: Philips LED String System, no date available.

* cited by examiner

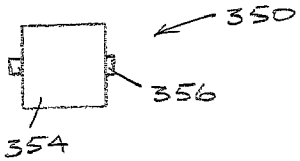
FIG. 17
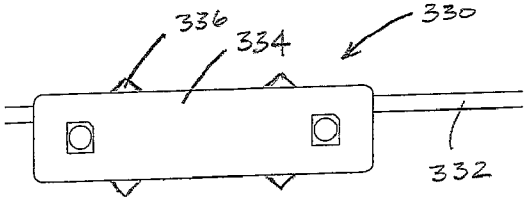
FIG. 18
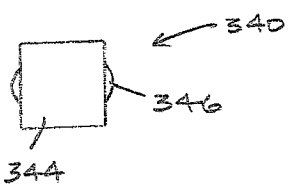
FIG. 19
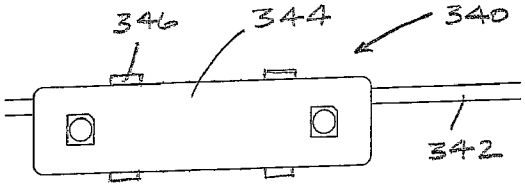
FIG. 20
FIG. 21
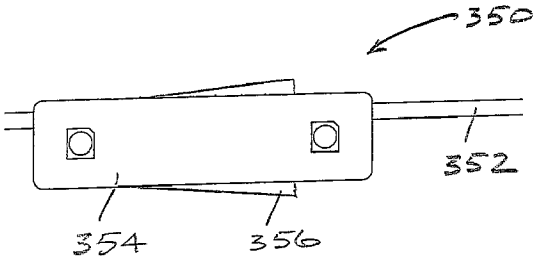
FIG. 22

LED STRING LIGHT ENGINE AND DEVICES THAT ARE ILLUMINATED BY THE STRING LIGHT ENGINE

This application is a continuation-in-part of U.S. Utility patent application Ser. No. 11/180,993 filed on Jul. 13, 2005 and entitled "LED STRING LIGHT ENGINE," the entirety of which is incorporated herein by reference.

BACKGROUND OF THE INVENTION

LED string light engines are used for many applications, for example as accent lighting, architectural lighting, and the like. The profile, i.e., the height and width, of known flexible LED light string engines is wide enough such that it can be difficult to install these known light string engines in certain environments.

LED string light engines are also used in channel letters. A typically channel letter has a five inch can depth, which is the distance between the rear wall of the channel letter and the translucent cover. To illuminate the channel letter, a string LED light engine attaches to the rear wall and directs light towards the translucent cover. To optimize efficiency, typically the LEDs are spaced from one another as far as possible before any dark spots are noticeable on the translucent cover. To achieve no dark spots, the LEDs are spaced close enough to one another so that the light beam pattern generated by each LED overlaps an adjacent LED as the light beam pattern contacts the translucent cover. Accordingly, the translucent cover is illuminated in a generally even manner having no bright spots or any dark spots.

Channel letters are also manufactured having a shallower can depth, such as about two inches. Typically, the smaller channel letters also have a smaller channel width. If the same light string engine that was used to illuminate the smaller channel letters is used to illuminate the larger channel letters, then bright spots may be noticeable because the beam pattern overlap is not as great where the beam pattern contacts the translucent cover.

LED string light engines are also used to illustrate many other devices; however, securely mounting the string light engine into the device has been an issue.

SUMMARY

A string light engine includes a flexible electrical conductor, a plurality of supports each including a dielectric layer and circuitry, a plurality of IDC connectors each extending away from a respective support, at least one LED mounted on each support, and a plurality of overmolded housings. Each IDC connector is in electrical communication with the circuitry of a respective support. Each IDC connector includes a terminal that provides an electrical connection between the conductor and the circuitry of the respective support. The LED is in electrical communication with the circuitry found on the support. Each overmolded housing at least substantially surrounds at least one support and a portion of the conductor adjacent the at least one support.

According to another example, a string light engine can include a flexible electrical conductor and a plurality of LED modules attached to the conductor. Each LED module includes an IDC connector, an LED electrically connected to the IDC connector, and an overmolded housing at least substantially surrounding the IDC connector and a portion of the conductor adjacent the IDC connector.

According to yet another example, a string light engine includes a plurality of LEDs, a plurality of IDC connectors, and a flexible conductor. Each IDC connector is in electrical communication with at least one of the plurality of LEDs and operatively mechanically connected to at least one of the plurality of LEDs. The IDC connectors include a terminal inserted into the conductor. The conductor is twisted between a first IDC connector of the plurality of IDC connectors and a second IDC connector of the plurality of IDC connectors.

Each of the aforementioned examples of string light engines can be used in combination with a device that is to be illuminated by the string light engine. The device includes a channel and the string light engine is disposed in the channel.

BRIEF DESCRIPTION OF THE DRAWINGS

FIG. 17 is a side elevation view of an LED module for a string light engine where the module incorporates an example of a mounting element used to connect the string light engine to a device that is to be illuminated by the string light engine.

FIG. 18 is a top plan view of the LED module depicted in FIG. 17.

FIG. 19 is another example of an LED module for a string light engine and a mounting element used to attach the string light engine to a device that is to be illuminated by the string light engine.

FIG. 20 is a top plan view of the LED module depicted in FIG. 19.

FIG. 21 is a side elevation view of another example of an LED module for a string light engine and a mounting element used to attach the string light engine to a device that is to be illuminated by the string light engine.

FIG. 22 is a top plan view of the LED module depicted in FIG. 21.

DETAILED DESCRIPTION

Figure 1:
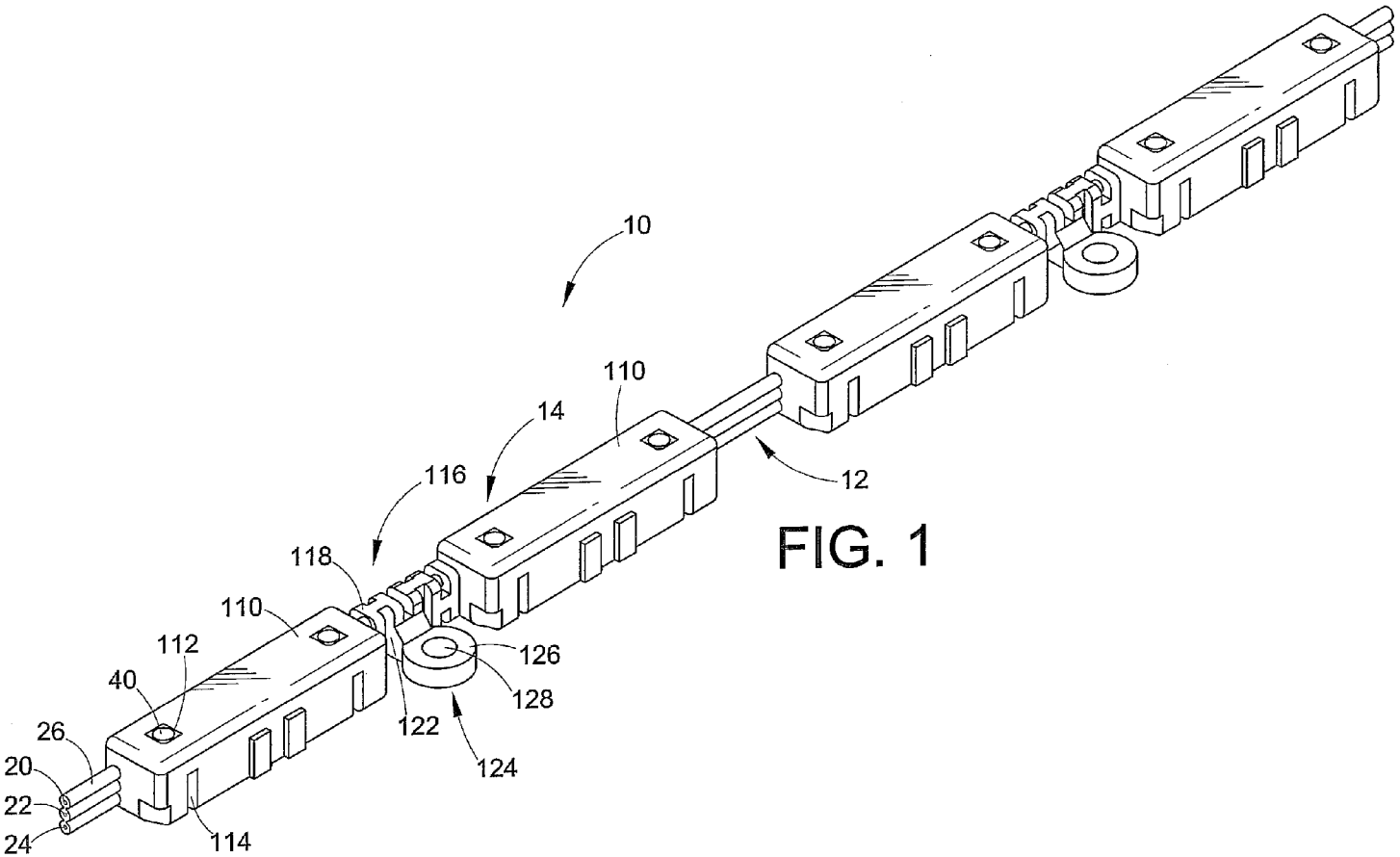
FIG. 1 is a perspective view of a string light engine.

With reference to FIG. 1, a flexible LED string light engine 10 generally includes a flexible electrical power conductor 12 and LED modules 14 attached along the length of the conductor. The light engine 10 is flexible so that it can be bent and shaped into many desirable configurations so that it can fit into, for example a channel letter, and can be used in many different environments. FIG. 1 depicts only a portion of the light engine which can extend along a much greater distance than that depicted in FIG. 1. The string light engine 10 can be manufactured to have the length of many feet or meters long. In one embodiment, the light sources, which will be described in more detail below, are spaced relatively close to one another to provide a desired beam overlap pattern. The string light engine 10 is configured to easily bend in a manner that will be described in more detail below.

The power conductor 12 in the depicted embodiment includes three conductor wires: a positive (+) conductor wire 20, a negative (−) conductor wire 22 and a series conductor wire 24. Accordingly, the LED modules 14 can be arranged in a series/parallel arrangement along the power conductor 12. A fewer or greater number of conductor wires can be provided. The wires in the depicted embodiment are 22 gauge, however other size wires can also be used. The conductor wires 20, 22 and 24 are surrounded by an insulating material 26.

In the depicted embodiment, the power conductor 12 is continuous between adjacent LED modules 14 such that the entire power conductor 12 is not cut or otherwise terminated to facilitate a mechanical or electrical connection between the LED module and the power conductor. A continuous power conductor 12 quickens the manufacturing of the light engine 10, as compared to light engines that terminate the power conductor when connecting it to an LED module.

Figure 2:
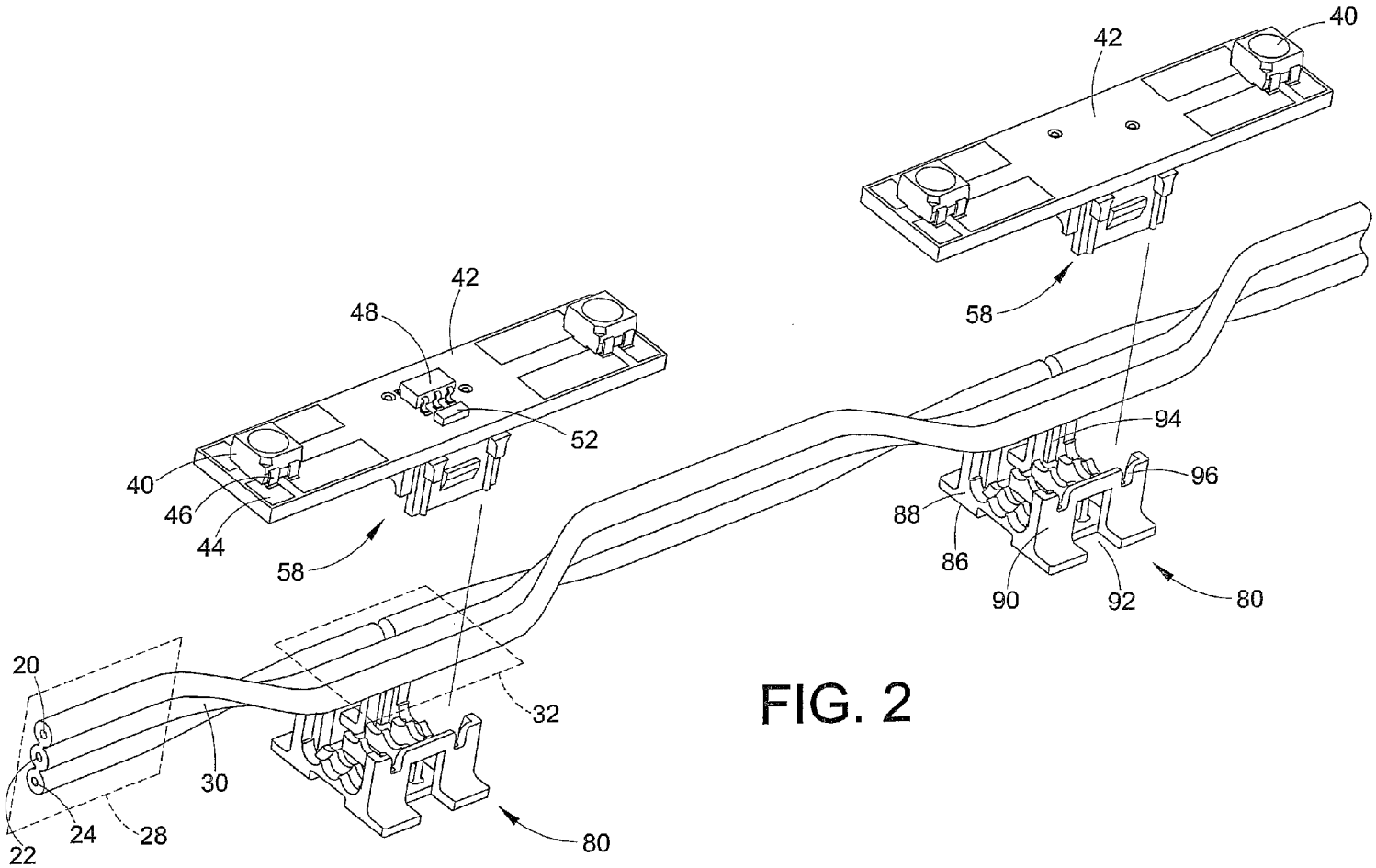
FIG. 2 is an exploded perspective view of components of the string light engine of FIG. 1.

The wires 20, 22 and 24 of the power conductor can be described as residing generally in a plane at different locations along the length of the power conductor. With reference to FIG. 2, the power conductors reside in a first or primary bending plane 28 adjacent each LED module. As seen in FIG. 2, the power conductor 12 includes a twist 30, which in the depicted embodiment is a one-quarter twist, such that the power conductor resides in a second or connection plane 32 where the LED module attaches to the power conductor 12. In an alternative embodiment, the twist 30 may not be a one-quarter twist; rather, the twist may be smaller where the two planes 28 and 32 may only be at an angle other than 180° from one another. The configuration of the power conductor 12 allows the LED light string 10 to easily bend in a direction that is at an angle to the primary bending plane 28. This is because the force(s) required to bend the power conductor 12 in the primary bending plane 28 is small because the width of the power conductor in the primary bending plane 28 is equal to the diameter of a conductor wire and the surrounding insulation as compared to the width of the power conductor in the connection plane 32 which equals the entire width of the power conductor 12. The twist 28 allows for a low-profile LED module to attach to the power conductor 12. In other words, the height and width of each LED module 14 can be smaller, as compared to known light string engines.

Figure 3:
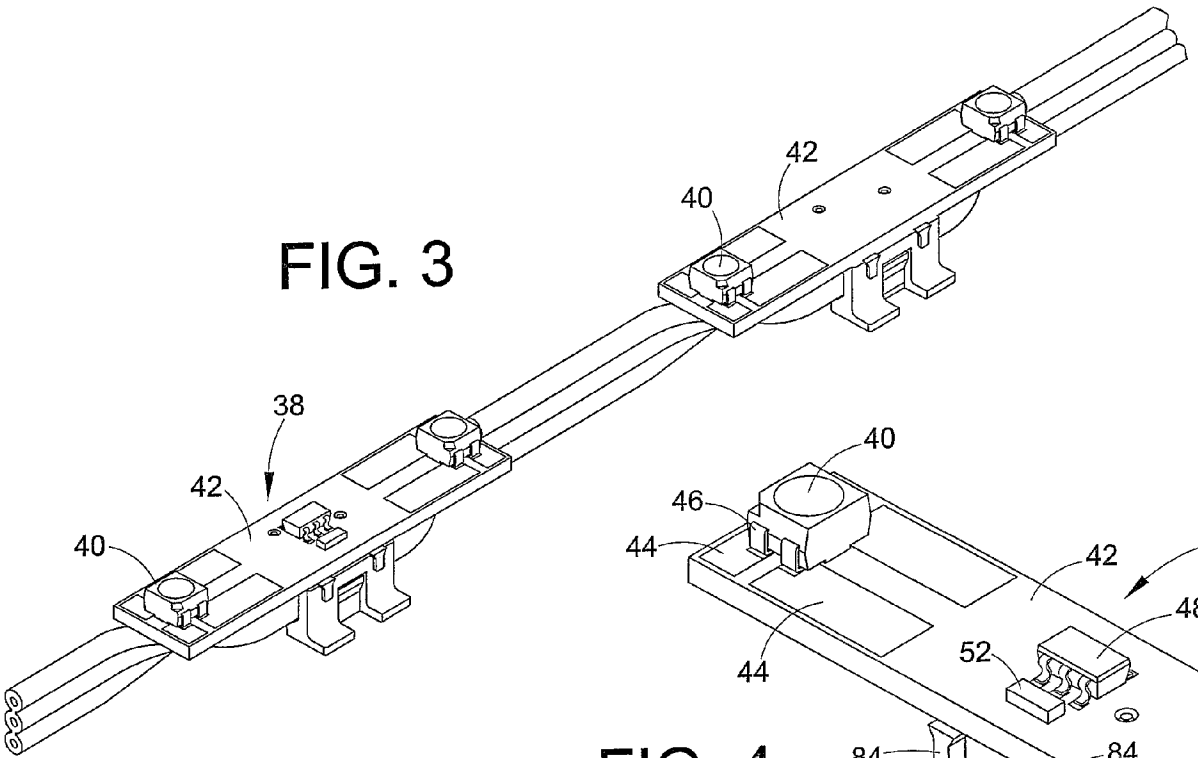
FIG. 3 is an assembled view of the string light engine of FIG. 1 prior to overmolding a housing on the string light engine.
Figure 4:
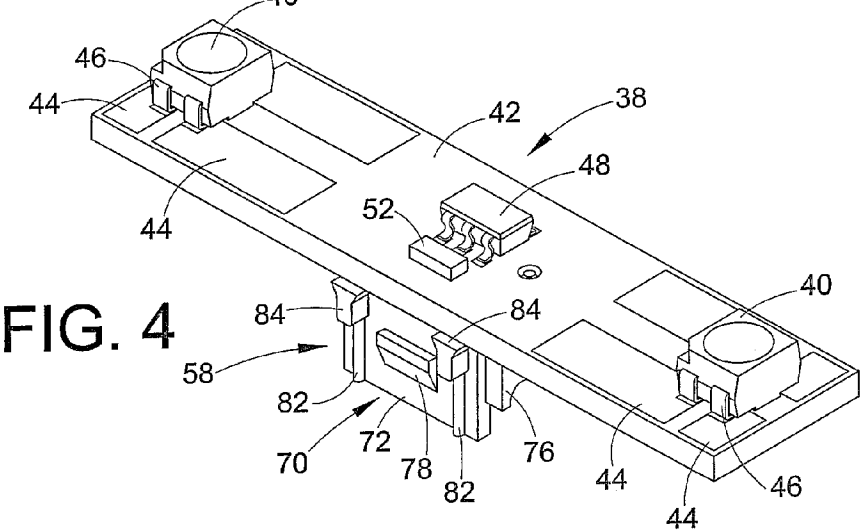
FIG. 4 is a perspective view of an assembly of the string light engine of FIG. 1.

The LED modules 14 attach to the power conductor 12 spaced along the length of the power conductor. In the embodiment depicted and as seen in FIG. 3, each LED module 14 includes an assembly 38 that attaches to the power conductor 12. With reference to FIG. 4, the assembly 38 includes at least one LED 40 (two LEDs are shown), which in the depicted embodiment is a surface mounted LED, placed on a support 42, which in the depicted embodiment is a printed circuit board ("PCB"). In the depicted embodiment, the printed circuit boards 42 that mount to the power conductor 12 have similar dimensions (see FIG. 3); however, the circuitry located on each PCB and the components that mount to each PCB can be different. Solder pads 44 are disposed on an upper dielectric surface of each PCB 42. Leads 46 for each LED 40 electrically connect to the solder pads 44.

An LED driver 48 mounts on the upper surface of some of the printed circuit boards 42. The LED driver 48 is in electrical communication with the LEDs 40. A resistor 52 also mounts on the upper surface of some of the printed circuit boards 42. The resistor 52 is also in communication with the LEDs 40. In the depicted embodiment some PCBs 42 are provided without resistors and LED drivers and some PCBs are not (see FIGS. 2 and 3). Accordingly, the circuitry located on each PCB 42 interconnecting the LEDs 40 to the power conductor 12 is different. In the depicted embodiment, two different wiring configurations are provided for the PCBs: one wiring configuration for the PCB having the resistor and LED driver and one wiring configuration for the PCB having no resistor or LED driver.

In an alternative embodiment, the support upon which the LED is mounted can be a flex circuit or other similar support. Furthermore, the LEDs that mount to the support, either the flex circuit or the PCB, can include chip on board LEDs and through-hole LEDs. Also, other electronics can mount to the support including a device that can regulate the voltage as a function of the LED temperature or the ambient temperature. Furthermore, these electronics, including the resistor, the LED driver, and any temperature compensating electronics can be located on a component that is in electrical communication with the LEDs but not located on the support.

With reference back to the depicted embodiment as seen in FIG. 4, an IDC connector 58 depends from a lower surface of the support 42. In the depicted embodiment, the IDC connector 58 is mechanically fastened to the support 42, which operatively connects the IDC connector to the LEDs 40. Even though the IDC connector is depicted as directly attaching to the support 42, other elements or components can be interposed between the two. When the IDC connector 58 attaches to the power conductor 12, the support 42 resides in a plane generally parallel with the connection plane 32 (FIG. 2).

Figure 5:
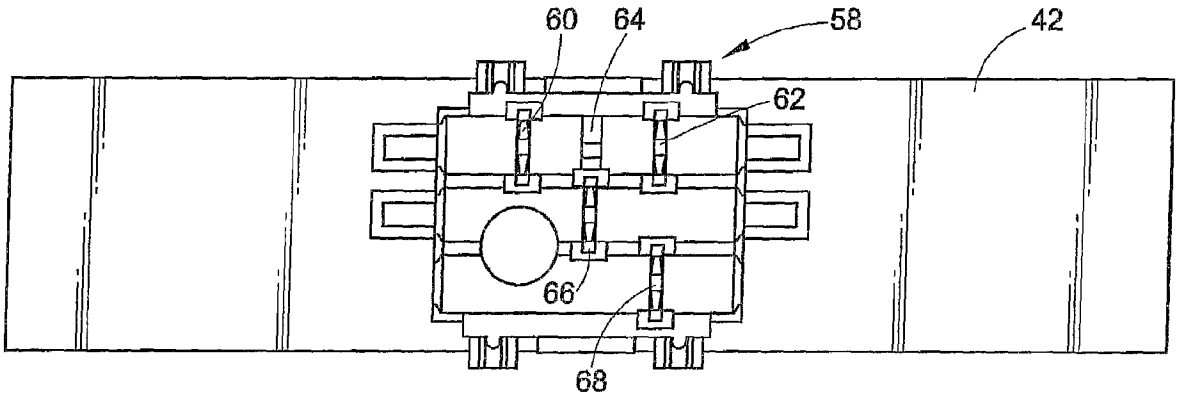
FIG. 5 is a bottom view of the assembly of FIG. 4.

With reference to FIG. 5, in the depicted embodiment the IDC connector 58 includes a plurality of IDC terminals. A first series IDC terminal 60 depends from a lower surface of the support 42 and is in electrical communication with the LEDs 40 through circuitry (not shown) printed on the upper dielectric layer of the support 42. A second IDC terminal 62 is spaced from the first series IDC terminal 60 and also depends from the lower surface of the support 42. The second series IDC terminal 62 is also in communication with the LEDs 40. The first and second series IDC terminals 60 and 62 pierce the insulation 26 surrounding the series wire 24 to provide an electrical connection between the LEDs 40 and the series wire. The IDC connector 58 in this embodiment also includes an insulative barrier 64 disposed between the first series terminal 60 and the second series terminal 62.

A negative IDC terminal 66 also depends from a lower surface of the support 42. Similar to the first series IDC terminal 60 and the second series IDC terminal 62, the negative IDC terminal 66 is in electrical communication with the LEDs 40 via circuitry disposed on an upper dielectric surface of the support 42. The negative IDC terminal 66 displaces insulation surrounding the negative wire 22 to provide an electrical connection between the LEDs 40 and the negative wire. A positive IDC terminal 68 also depends from a lower surface of the support 42. The positive IDC terminal 68 is in electrical communication with the LEDs 40 via circuitry provided on an upper surface of the support 42. The positive IDC terminal 68 displaces insulation 26 surrounding the positive wire 20 to provide for an electrical connection between the LEDs 40 and the positive wire. In the depicted embodiment, each IDC connector 58 has the same electrical configuration. The support 42 to which the connector 58 attaches has a different electrical configuration based on the electrical components mounted on the support. For example, the IDC terminals for one connector can electrically communicate with the resistor 52 and/or the LED driver 48 that is located on some of the supports 42.

Figure 6:
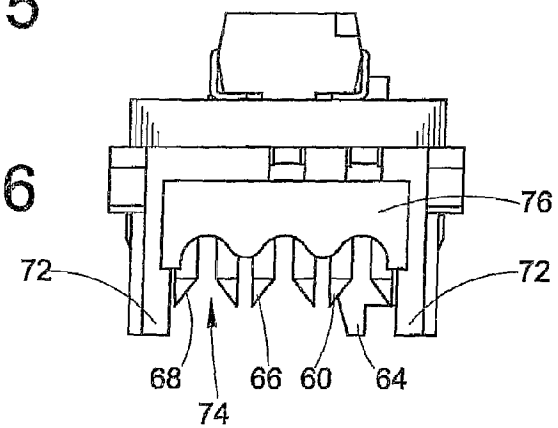
FIG. 6 is an end view of the assembly of FIG. 4.

With reference back to FIG. 4, the IDC connector 58 also includes an IDC connector housing 70 that includes dielectric side walls 72, which in the depicted embodiment are made of plastic, which depend from opposite sides of the support 42 in the same general direction as the IDC terminals. As seen in FIGS. 5 and 6, the IDC terminals 60, 62, 66, and 68 are disposed between the sidewalls 72. With reference to FIG. 6, the sidewalls 72 are spaced from one another to define a channel 74 configured to snugly receive the power conductor 12. A power conductor seat 76 depends from a lower surface of the support 42 in the same general direction as the IDC connectors and the sidewalls 72. The seat 76 includes three curved recesses, one recess for each wire of the power conductor 12. A tab 78 extends from each sidewall 72 to facilitate attaching the IDC connector housing 70 to an IDC cover 80 (FIG. 2). Each sidewall 72 also includes vertical ridges 82 formed on opposite sides of each tab 78. The vertical ridges 82 also facilitate attachment of the IDC connector housing 70 to the IDC cover 80. Stops 84 extend outwardly from each sidewall 72 at an upper end of each vertical ridge 82. The stops 84 extend further from each sidewall 72 than the vertical ridges 82.

As seen in FIG. 2, the IDC cover 80 includes a base wall 86 defining an upwardly extending power conductor seat 88 that includes curved portions for receiving the separate wires of the power conductor 12. The curved portions of the power conductor seat 88 align with the curved portions of the power conductor seat 74 of the IDC connector housing 70. Sidewalls 90 extend upwardly from opposite sides of the base wall 86 of the IDC cover 80. Each sidewall 90 includes an opening 92 configured to receive the tab 78 extending outwardly from each sidewall 72 of the IDC connector housing 70. Internal vertical notches 94 are formed on an inner surface of each sidewall 90 to receive the vertical ridges 82 formed on the sidewalls 72 of the IDC connector housing 70. Notches 96 are formed in each sidewall 90 of the IDC cover 80 to receive the stops 84 formed on the IDC connector housing 70.

The support 42 attaches to the power conductor 12 by pressing the support into the power conductor 12 such that the IDC terminals 60, 62, 66 and 68 displace the insulation 26 around each wire of the power conductor. The cover 80 is then pressed toward the support 42 such that the tabs 78 lock into the notches 92 to secure each support 42 to the power conductor 12. The tabs 78 are ramped to facilitate this connection. When attached to the power conductor 12, the support resides in a plane that is generally parallel to the connection plane 32.

With reference back to FIG. 1, an overmolded housing 110 at least substantially surrounds each support 42 and a portion of the conductor 12 adjacent each support. The overmolded housing includes openings 112 through which an upper surface of each LED 40, which is typically covered by a lens, extends. Accordingly, in the depicted embodiment the overmolded housing 110 does not completely encapsulate the support 42 to the LEDs 40; however, if desired the housing could cover the LEDs 40, especially if the housing were to be made of a light-transmissive material. Each overmolded housing 110 also includes notches 114 formed in the overmolded housing for supporting the support 42 during overmolding, which will be described in more detail below.

In the depicted embodiment, a strain relief member 116 is disposed between adjacent overmolded housings 110 and surrounds the power conductor 12. The strain relief member 116 includes a plurality of loops 118 that surround the power conductor 12 and are separated by openings 122. The strain relief members are configured to limit any forces on the conductor 12 that are external the overmolded housing 110 from transferring to the portion of the power conductor 12 disposed inside the overmolded housing. This is to limit any stresses on the IDC connector 58 so that good mechanical and electrical connection is maintained between the support 42 and the IDC connector.

A mounting element 124 connects to the power conductor 12 extending from the strain relief member 116. In the depicted embodiment, the mounting element 124 comprises a loop 126 defining an opening 128 dimensioned to receive a fastener (not shown). The mounting element 124 can take alternative configurations to allow the light engine 10 to attach to a mounting surface. Furthermore, the light engine 10 can mount to a mounting surface via an adhesive that attaches to either the power conductor 12 or the overmolded housing 110, as well as in other conventional manners.

Figure 7:
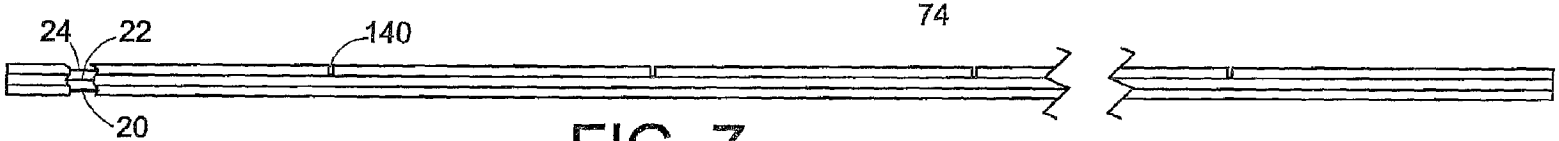
FIG. 7 is a plan view of a power conductor of the string light engine of FIG. 1.

To assemble the light engine 10 the series conductor wire 24 of the power conductor 12 is punched out to form slots 140 (FIG. 7) at predetermined locations along the power conductor 12. The power conductor 12 is twisted (see FIG. 2). Each support 42 and the accompanying IDC connector housing 70 and IDC terminals 60, 62, 66 and 68 are disposed such that the connector insulation barrier member 64 (FIGS. 5 and 6) of each IDC connector housing is disposed inside the slot 140 and the IDC terminals contact the respective conductor wires of the power conductor 12. The IDC cover 80 is then fit over the IDC connector housing 70 so that the power conductor 12 is fully seated in each of the power conductor seats 74 and 86. The overmolded housing 110 is then formed over the support 42 and the power conductor 12 adjacent the support.

With reference back to FIG. 1, in one method two adjacent housings 110 and the interconnecting strain relief member 116 along with the mounting element 124 are formed from as an integral unit. Two adjacent supports 42 can be inserted into a mold and a thermoplastic, for example a thermoplastic elastomer, is injected into the mold to form the overmolded housing 110. Instead of an elastomer, i.e., a material that is flexible after solidifying, the overmolded housing can also be a rigid plastic, or other suitable material. When using the injection molding thermoplastic process as described above, the thermoplastic is typically injected at pressures between about 5-35 kpsi and at temperatures in the range of about 140-500° C., and typically between about 140-230° C. The thermoplastic then cools and is removed from the mold. Alternatively, the overmolded housing can be formed using a liquid injection molding process and/or a casting process. The power conductor 12 and the assembly 38 can also be run through an extruder so that the overmolded housing is extruded over the assembly and the power conductor.

In other embodiments the entire light engine 10, or a substantial portion thereof, can be overmolded. The thermoplastic used to make the overmolded housing can be opaque. As discussed above, the upper surface of each LED 42 is not covered; however, in an alternative embodiment the upper surface of each LED can be covered where the overmolded housing is formed of a light-transmissive material. The overmolded housing 110 provides a further mechanical connection between the support 42 and the power conductor 12 as well as acting as a barrier from the elements for the components disposed inside the overmolded housing. The overmolded housing 110 also provides for thermal management of the LED modules 14. The overmolded housing 110 increases the surface area of the LED module, as compared to having no housing, which has been found to lower the thermal resistance to the ambient, as compared to having no housing.

Figure 8:
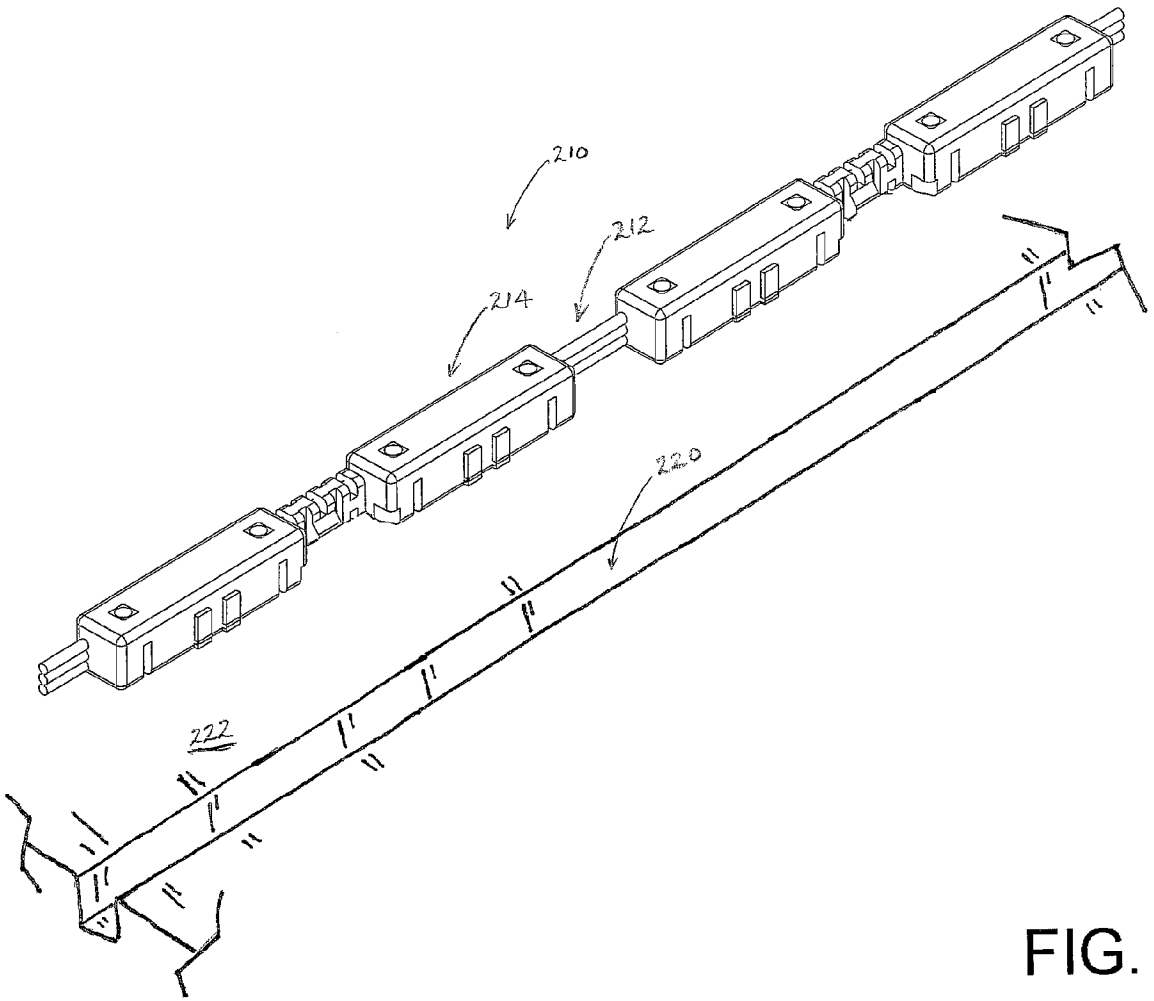
FIG. 8 is a perspective view of a string light engine similar to that disclosed in FIG. 1 and a channel formed in a device that is to be illuminated by the string light engine.

With reference to FIG. 8, another example of a string light engine 210 generally includes a flexible electrical power conductor 212 and a plurality of LED modules 214 attached along the length of the conductor. The string light engine 210 is similar to the string light engine 10 described above; however, in this example the string light engine 210 does not include the loop mounting elements that are disclosed in FIG. 1. The LED modules 214 are similar to the modules 14 described above and the electrical power conductor 212 is similar to the power conductor 12 described above.

Figure 9:
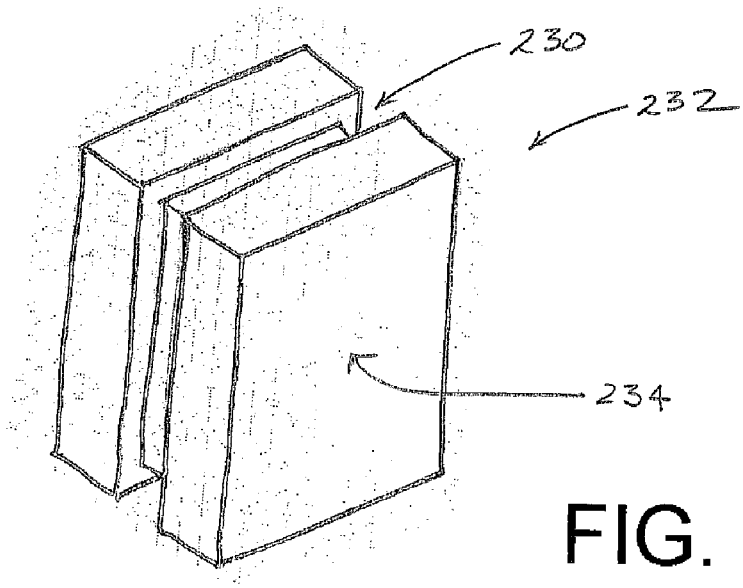
FIG. 9 is a perspective view of an example of a device, more particularly, a backlighting sheet, that is to be illuminated by the string light engine of FIG. 8.
Figure 10:
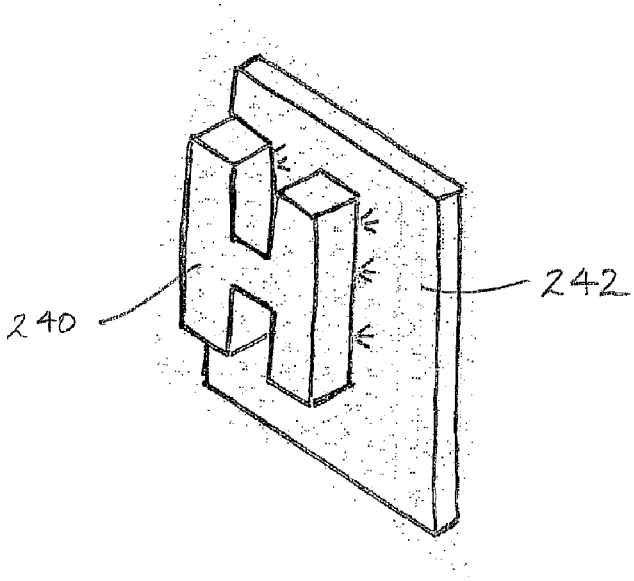
FIG. 10 is a front perspective view of another example of a device, more particularly a reverse halo letter assembly, that is to be illuminated by the string light engine of FIG. 8.
Figure 11:
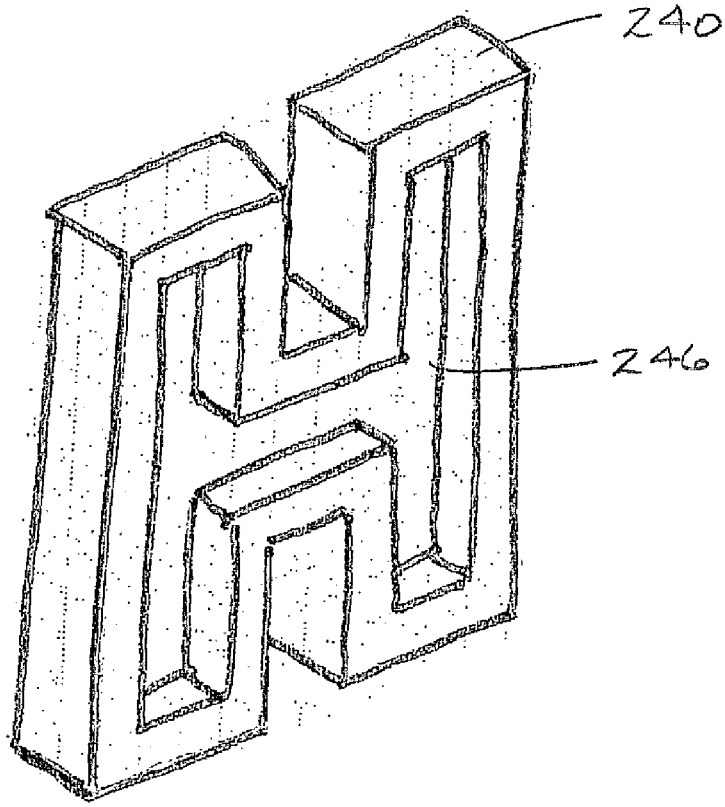
FIG. 11 is a rear perspective view of the halo letter depicted in FIG. 10.

The string light engine 212 is received in a channel 220 formed in a device 222 that is to be illuminated by the string light engine 210. Examples of devices that can be lighted by the light engine (or other light engines) include channel letters, low profile channel letters, border lighting, reverse halo applications, large box signs, POP signage, cove lighting, canopy lighting, accent lighting, and backlighted sheets. FIG. 9 depicts one example of a device that can be lighted by the light engine 210 that includes a channel 230 formed in a backlighted sheet 232. Typically, the sheet 232 is used to illuminate a translucent panel that is disposed over one of the larger planar surfaces 234 of the sheet. FIG. 10 depicts another example of a device that can be illuminated by a light engine. FIG. 10 depicts a reverse halo application including a letter 240 and surface 242 to which the letter is mounted. As seen more clearly in FIG. 11, a channel 246 into which the light engine 210 (FIG. 8) can be fitted is found on the back side of the letter 240. Even though a rectangular sheet 232 and a letter 240 are shown as examples of devices that are to be illuminated by the string light engine 210, these devices can take other configurations.

Figure 12:
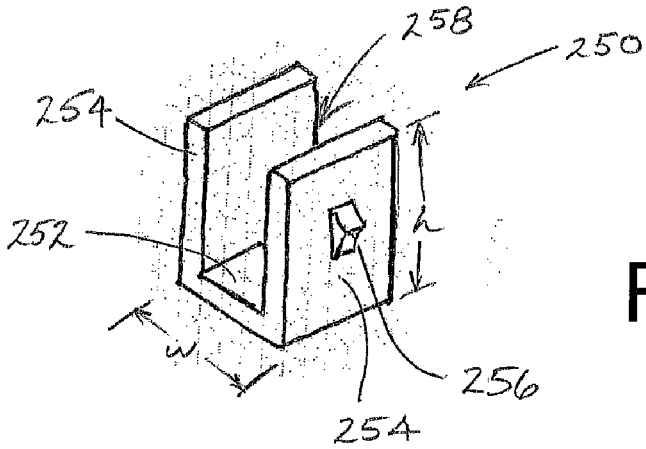
FIG. 12 is a perspective view of an example of a mounting element for use with the string light engine depicted in FIG. 8.

With reference to FIG. 12, an example of a mounting element, which in this example is a clip 250, is used to attach the string light engine 210 (FIG. 8) into the channel 220 (FIG. 8 or other channels 230 and 246) of the illuminated device 222. The clip 250 is generally U-shaped having a base portion 252 and two lateral portions 254 extending upwardly from and normal to the base portion 252. A barb 256 protrudes outwardly from the lateral portion 254 (only one barb is visible in FIG. 12, however, an additional barb can be disposed on the opposite lateral portion). The base portion and the lateral portions define a channel 258 that is configured to receive the LED module 214 (FIG. 8), for example. The clip 250 can be made from a resilient or springy material, e.g. metal, so that the clip snaps around and snugly receives the LED module. The width w of the clip 250 is dimensioned such that it can be snuggly received inside the channel 220 (FIG. 8, or other channels in the illuminated devices, such as channel 230 in FIG. 9 and channel 246 in FIG. 11) of the illuminated device so that the barbs 256 engage side walls of the channel to provide a friction or resilient fit of the light engine 210 inside the channel. The height h of the clip 250 is generally less than or equal to the depth of the channel 220 to which the light engine 210 is inserted. Desirably, the height h of the clip is less than the height of the LED module so that the clip does not block any light that is emanated from the LED module.

Figure 13:
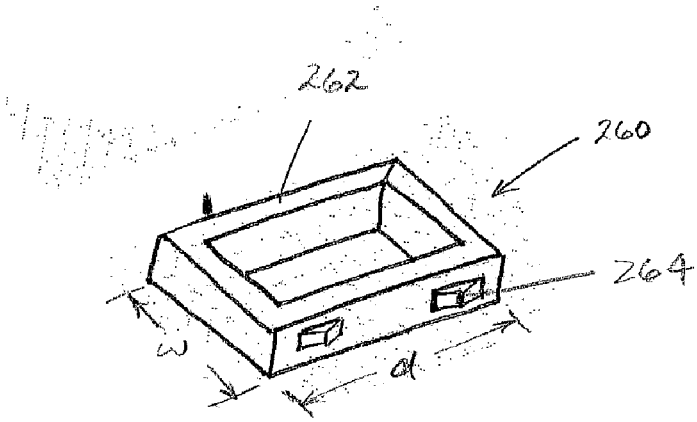
FIG. 13 is a perspective view of another example of a mounting element for use with the string light engine depicted in FIG. 8.

FIG. 13 discloses another example of a mounting member or element, which in this case is a clip 260 that wraps around the periphery of the LED module 214 of the string light engine 210 (FIG. 8). The clip 260 in this example includes a metal (or similar formable material) member 262 that can be bent into a shape that fits around the LED module. The clip 260 includes a plurality of barbs 264 that extend outwardly from the lateral sides of the clip. The clip has a width w such that the clip 260 and the LED module received in the clip fit into the channel (for example, channel 220) where the barbs 264 engage a side surface of the channel to retain the string light engine in the channel.

Figure 14:
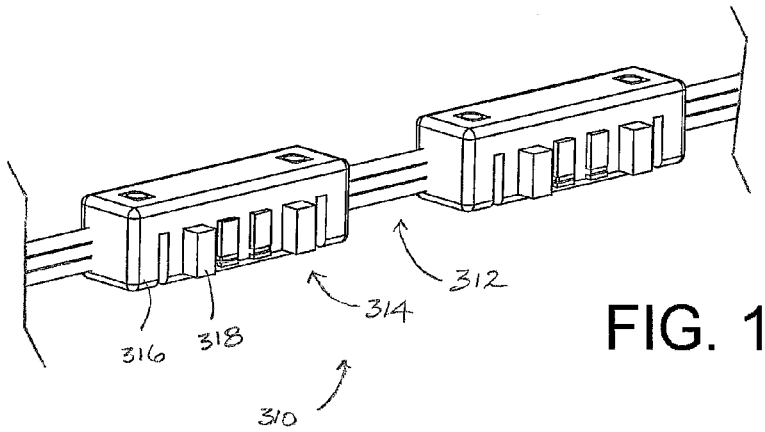
FIG. 14 is a perspective view of another example of a string light engine.
Figure 15:
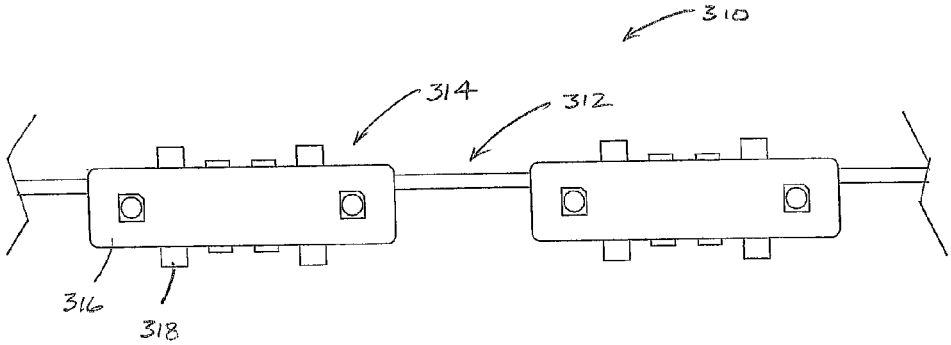
FIG. 15 is a top plan view of the string light engine depicted in FIG. 14.
Figure 16:
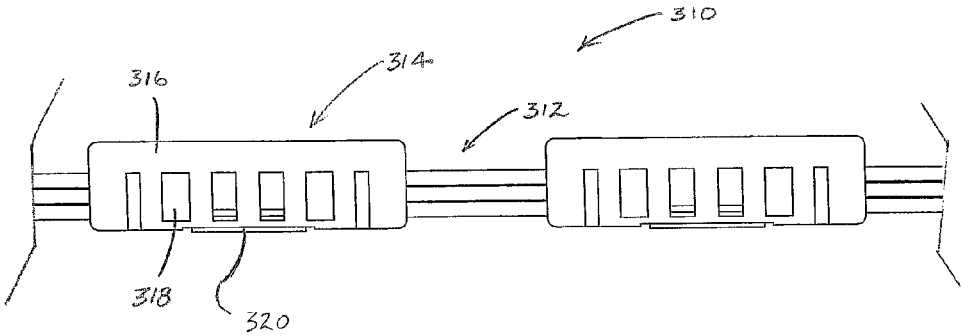
FIG. 16 is a side elevation view of the string light engine depicted in FIG. 14.

With reference to FIG. 14, a string light engine 310 is disclosed that includes a flexible electrical conductor 312 and a plurality of LED modules 314. The flexible electrical conductor 312 is the same as the electrical conductor 212 that is described above. The LED modules 314 are similar to the LED modules 14 that are described above with the exception that the overmolded housing 316 of each LED module includes a plurality of mounting elements 318 that facilitate the connection between the string light engine 310 and the channel (for example channel 220 in FIG. 8, channel 230 in FIG. 9, and channel 246 in FIG. 11) of the device that is to be illuminated by the string light engine. The mounting elements 318 in the example depicted in FIGS. 14-16 are generally block-shaped tabs having a generally rectangular parallelopiped configuration. The tabs 318 are formed integrally with the overmolded housing and extend outwardly from the housing to define an outermost surface on each lateral side, which is the longest side of the housing. Four tabs 318 for each LED module 314 are shown; however, a fewer or greater number of tabs can be provided. The tabs 318 can be made of the same material as the remainder of the overmolded housing, which can be a resilient material that deforms when the light string engine 210 is inserted into a channel, such as channel 220 in FIG. 8. Alternatively, the channel into which the light engine is to be inserted can be made from a resilient or deformable material such that when the light engine is inserted into the channel, the channel surface is deformed around the tab 318 to retain the string light engine in the channel. To further facilitate attachment of the string light engine inside a channel, an additional mounting member such as double-sided tape 320 is provided on an undersurface of the housing 316. The housing 316 can be made of a material having heat conductive properties that are greater than air. Heat can be dissipated from the housing 316 through the tape 320 and into the device that is to be illuminated by the string light engine where the device is made of or includes a material that has heat conductive properties that are greater than air.

With reference to FIGS. 17 and 18, another example of an LED module 330 attached to a flexible electrical power conductor 332 is shown. The power conductor 332 is similar to power conductors described above. The LED module 330 is similar to the LED modules that are described above; however, the overmolded housing 334 includes integral pointed tabs 336 as a mounting element for facilitating attachment of the string light engine inside a channel of a device that is to be illuminated by the string light engine.

With reference to FIGS. 19 and 20, an alternative embodiment an LED module 340 is shown attached to a flexible electrical power conductor 342. The power conductor 342 is similar to the power conductors that have been described above. The LED module 340 is also similar to the modules that have been described above except that the overmolded housing 344 includes integrally formed rounded tabs 346 as mounting elements for facilitating attachment of the LED module 340 inside a channel formed in a device that is to be illuminated by the string light engine.

With reference to FIGS. 21 and 22, an alternative embodiment of an LED module 350 attaches to a flexible electrical conductor 352 that is similar to this flexible electrical conductors described above. The LED module is also similar to the LED modules described above except that the overmolded housing 354 includes integrally formed wings 356 that extend from lateral sides of the overmolded housing 354.

With reference to the overmolded housing shown in FIGS. 17-22, the mounting elements 336, 346 and 356 can be made of the same material as the remainder of the respective housing to which the mounting elements attach. The mounting elements can be integrally formed or later attached to the respective overmolded housings. The mounting elements can be made of a resilient material that deforms when the respective LED module is inserted into a channel having a width that is slightly smaller than the distance between the outermost edges of the respective mounting elements. Also, the device in which the channel is formed can be made from a resilient and/or deformable material that deforms upon insertion of the respective LED modules into the channel.

Figure 23:
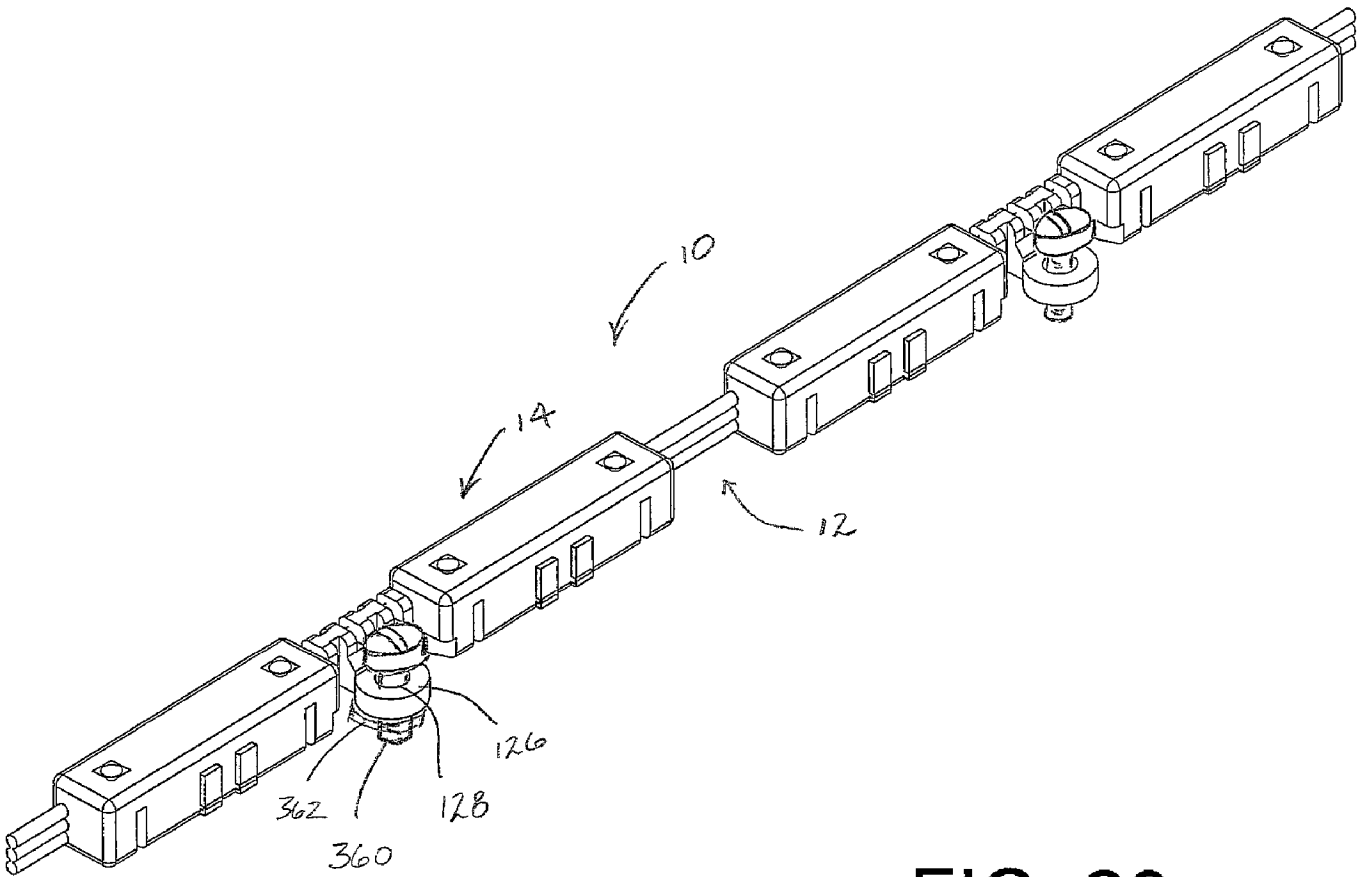
FIG. 23 is a perspective view of the string light engine depicted in FIG. 1 having a plurality of self-tapping screws attached to the string light engine.

FIG. 23 discloses the LED string light engine 10 that is disclosed in FIG. 1 with self-tapping screws 360 disposed in the opening 128 formed in the loop 126 that comprises the mounting element for the LED light engine. The self-tapping screw 360 can be inserted at the manufacturing center and shipped with the string light engine so that the installer of the string light engine need not insert individual fasteners inside the openings of the mounting element which will quicken the installation of the string light engine. A washer 362, or similar retaining device, can be provided to fix the fastener 360 inside the opening 128 prior to shipping the string light engine.

Figure 24:
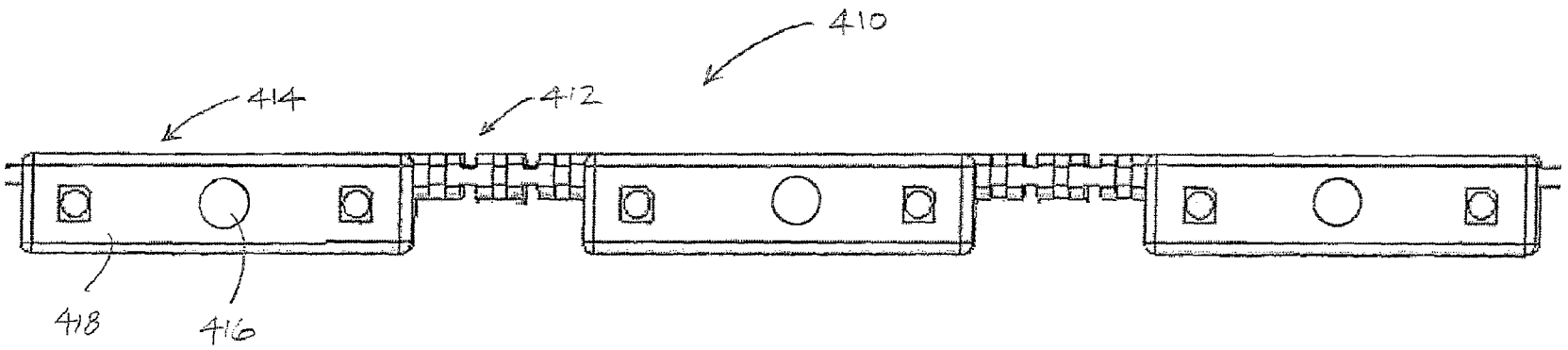
FIG. 24 is a top plan view of another example of a string light engine including a mounting element for mounting the string light engine to a device that is to be illuminated by the string light engine.

FIG. 24 discloses a string light engine 410 also configured to attach to a structure using fasteners. The string light engine includes a flexible electrical power conductor 412 which is similar to the electrical power conductors described above and a plurality of LED modules 414 are similar to those described above; however, each module includes an opening 416 formed through the module to receive a fastener for attaching the string light engine 410 to another structure. The LED modules described above each include a printed circuit board, or other support. The LED module 414 also includes such a printed circuit board, or similar support, but the electrical configuration would be such that the opening 416 could be accommodated through the support. The overmolded housing 418 of each LED module 414 would be formed such that the electrically non-conductive material of the overmolded housing 418 extends through the opening 416 to electrically isolate any fastener received in the opening 416 from the electrical internal components of the LED module.

Figure 25:
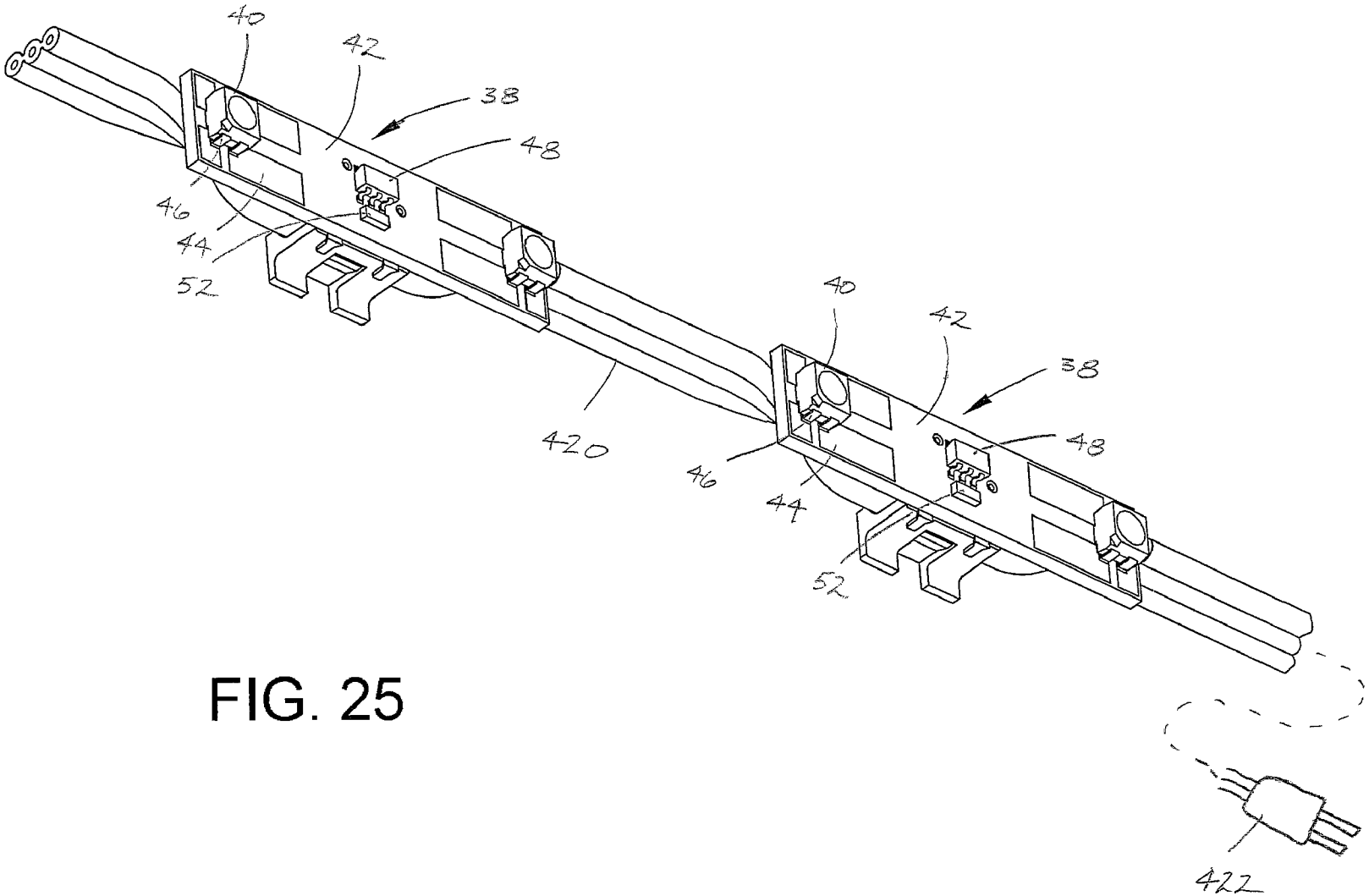
FIG. 25 is an assembled view of an example of a string light engine prior to over molding a housing on the string light engine.

FIG. 25 depicts assemblies 38 that each include an LED driver 48 and a resistor 52 disposed on the upper surface of printed circuit boards 42. The LEDs 40 attach to solder pads 44 via leads 46. Each assembly 38 can include an LED driver 48 and a resistor 52 so that the power cord 420 can be cut anywhere along the power cord and the LEDs 40 that remain in electrical communication with the power source so that the LEDs remain lit. The power cord 420 can also be in electrical communication with a plug 422 that is configured to fit into a wall outlet having, for example, 120 VAC. The LED driver 48 and the resistor 52 can be configured to condition the power received from the wall outlet to drive the LEDs 40 disposed on the printed circuit board 42.

String light engines and methods for manufacturing string light engines have been described with reference to certain embodiments. Modifications and alterations will occur to those upon reading and understanding the detailed description. The invention is not limited to only those embodiments described above; rather, the invention is defined by the appended claims and the equivalents thereof.

The invention claimed is:

1. A string light engine comprising:

a flexible electrical conductor;

a plurality of supports each comprising a dielectric layer and circuitry;

a plurality of IDC connectors each extending away from a respective support and in electrical communication with the circuitry of the respective support, each IDC connector including a terminal that provides an electrical connection between the conductor and the circuitry of the respective support;

at least one LED mounted on each support and in electrical communication with the circuitry of the support; and plurality of overmolded housings, each housing at least substantially surrounding at least one support of the plurality of supports.

2. The light engine of claim 1, further comprising a plug in electrical communication with the conductor, the plug being configured to plug into an associated wall outlet.

3. The light engine of claim 1, further comprising a mounting element associated with at least one of the housings.

4. The light engine of claim 3, wherein the mounting element comprises a tab extending from a lateral side of the housing, the tab being configured to provide a friction fit between a side surface of a channel into which the light engine is placed.

5. The light engine of claim 3, wherein the mounting element comprises a resilient clip that connects to the housing, the resilient clip including barbs.

6. The light engine of claim 3, wherein the mounting element and the overmolded housing are an integrally formed unit.

7. The light engine of claim 3, wherein the mounting element comprises a fastener and the at least one housing and the at least one support substantially surrounded by the at least one housing includes an opening to receive the fastener.

8. The light engine of claim 7, wherein the housing comprises a dielectric material and the opening is surrounded by the dielectric material of the housing entirely through the opening.

9. The light engine of claim 1, wherein the conductor is twisted between adjacent supports.

10. A string light engine comprising:

a flexible electrical conductor; and a plurality of LED modules attached to the conductor, each module comprising:

an IDC connector, an LED electrically connected to the IDC connector, an overmolded housing at least substantially surrounding the IDC connector and a portion of the conductor adjacent the IDC connector, and a support including circuitry, the IDC connector being mechanically connected to the support and electrically connected to the circuitry and the LED being mounted on the support.

11. A string light engine comprising:

a plurality of LEDs;

a plurality of IDC connectors, each IDC connector being in electrical communication with at least one of the plurality of LEDs and operatively mechanically connected to at least one of the plurality of LEDs;

a flexible conductor including at least two wires, the IDC connectors including a terminal inserted into the conductor, the conductor being twisted between a first IDC connector of the plurality of IDC connectors and a second IDC connector of the plurality of IDC connectors.

12. In combination, the string light engine of claim 10, and a device that is to be illuminated by the string light engine, the device including a channel and the string light engine being disposed in the channel.

13. The combination of claim 12, wherein the housing of at least one of the plurality of LED modules is configured to engage a side surface of the channel to provide a friction fit of the housing inside the channel.

14. The combination of claim 12, further comprising a clip connected to the housing of at least one of the plurality of LED modules, the clip engaging a surface of the channel to connect the string light engine inside of the channel.

15. The combination of claim 12, wherein the device comprises at least one of a channel letter, a component of a reverse halo sign, a backlighting sheet, a box sign and a border tube.

16. A string light engine comprising:

a flexible electrical conductor; and a plurality of LED modules attached to the conductor, each module comprising:

an LED in electrical communication with the flexible electrical conductor, an overmolded thermoplastic elastomer housing at least substantially surrounding the LED and contacting a portion of the conductor adjacent the LED, and a mounting element associated with the housing, wherein the mounting element comprises a tab extending from a lateral side of the housing, the tab being configured to provide a friction fit between a side surface of a channel into which the light engine is placed.

17. The string light engine of claim 16, wherein the overmolded housing comprises thermoplastic elastomer material having heat conductive properties that are greater than air.

18. The light engine of claim 11, further comprising a plurality of supports, each support being connected to at least one of the IDC connectors and at least one of the LEDs.

19. The light engine of claim 11, further comprising an overmolded housing at least partially encapsulating at least one of the plurality of LEDs, at least one of the plurality of IDC connectors and at least a portion of the flexible conductor.

20. The light engine of claim 19, wherein the overmolded housing comprises material having heat conductive properties that are greater than air.

21. The string light engine of claim 16, wherein each LED module includes an IDC in electrical communication with the LED and the flexible electrical conductor.

22. The string light engine of claim 16, wherein each LED module includes a support comprising a dielectric layer and circuitry, wherein the housing at least substantially surrounds the support.

23. The string light engine of claim 16, wherein the housing includes a strain relief member configured to limit any forces on the conductor that are external the housing to transfer to the portion of the conductor that is in contact with the housing.

* * * * *